US005323941A

United States Patent [19]

Sobolev

[11] Patent Number: 5,323,941

[45] Date of Patent: Jun. 28, 1994

[54] DEVICE FOR CARRYING AN UMBRELLA

[76] Inventor: Evgeny I. Sobolev, Schelkovskoe shosse, 87, korpus 1, kv. 168, Moscow, Russian Federation

[21] Appl. No.: 53,258

[22] Filed: Apr. 28, 1993

[51] Int. Cl.[5] ..... A45B 11/02

[52] U.S. Cl. ..... 224/181; 224/186; 224/915; 135/15.1

[58] Field of Search ..... 224/915, 181, 188, 186, 224/202, 208, 251, 187; 135/15.1, 16

[56] References Cited

U.S. PATENT DOCUMENTS

| | | | |
|---|---|---|---|
| 1,827,524 | 10/1931 | Hilburger | 224/186 |
| 1,850,497 | 3/1932 | Crumby | 224/188 |
| 2,085,984 | 7/1937 | Kruithof . | |
| 2,140,647 | 12/1938 | Myers | 224/181 X |
| 3,090,052 | 12/1945 | Levine | 224/181 |
| 3,700,149 | 10/1972 | Grogan . | |
| 3,892,251 | 7/1975 | Warfield | 224/186 X |

FOREIGN PATENT DOCUMENTS

| | | | |
|---|---|---|---|
| 9056 | 3/1880 | Fed. Rep. of Germany | 224/186 |

*Primary Examiner*—Ernest G. Cusick
*Attorney, Agent, or Firm*—Keck, Mahin & Cate

[57] ABSTRACT

A device for carrying an umbrella includes a tape support of a ring form which is fixed on the upper part of a user's torso so as to embrace the shoulder of one arm and the armpit of the other arm. An elastic pocket receives the umbrella handle and is able to rotate with respect to the tape support when the umbrella is lowered along the user's body. An auxiliary tape support, also of a ring form, is fixed on the occipitofrontal part of the user's head and has a loose loop fastener with a button for fixing the upper part of the umbrella stick when the umbrella is in an unfolded position. Both of the tape supports are made of elastic material.

13 Claims, 7 Drawing Sheets

DEVICE FOR CARRYING AN UMBRELLA

BACKGROUND OF THE INVENTION

1. Field of the Invention

The invention relates to the protection of a human being against atmospheric precipitates and solar radiation and, particularly, to a device for carrying an umbrella.

The device is designed to be widely used in everyday life as well as during agricultural work, such as for example, while picking up cotton or tea leaves when both hands of a worker are occupied.

2. Description of Related Art

One of the most widely used individual devices for the protection of a human being against rain or sun rays is an umbrella which is held over the head with one hand (right or left) so that the owner of the umbrella can carry or cart some load (such as a bag, suitcase or the like) with the other hand.

In practice, however, it often happens that a person has to carry loads with both hands under unfavorable weather conditions when it is necessary to have protection against, for example, rain.

Invalids walking with crutches along the street cannot use umbrellas at all.

When working under burning sun rays, e.g., while picking up cotton, the need for a shade for a human being is critical. However, since cotton picking operators have to make use of both hands, they cannot hold sun umbrellas. Therefore, various devices are used to solve the problem of the protection of a human being against unfavorable weather factors and to free both hands at the same time.

Known in the art is a device for carrying an umbrella on the body of a human being (See U.S. Pat. No. 3,700,149) which allows the umbrella stick to be fastened on the breast (or on the back side) on an individual by means of a horizontal belt and a vertical belt put over the shoulder and having a holding device for the stick on the torso, in the shoulder area, and a holding device for a handle of the umbrella in the waist zone so as to free the hands of the user from holding the umbrella over the head.

Also known in the art is a device for carrying an umbrella (See U.S. Pat. No. 2,085,984) having a pair of tape supports with a rigid pocket for holding a handle of the umbrella between them. The tape supports are belts and one of them is put on the waist and the other is fixed to an upper part of the body of a user to embrace the arm of one hand and to pass under the armpit of the other arm. This design eliminates the pocket displacement with respect to the body of the user, and the attachment of the pocket to a pair of tape supports requires the pocket to be made rather long.

The above and other devices of similar type are somewhat inconvenient in use because of a long and rigid pocket attached to the supports on the waist and shoulder. The rigid pocket hampers the user's movements, especially when a person leans over. The umbrella handle is placed in the upper part of the pocket so the handle can deviate from the upright right position which results in the umbrella being unstable under strong wind due to a large portion of the umbrella stick protruding from the pocket.

In addition, the rigid pocket which has to be fastened to the two supports makes the whole structure cumbersome and heavy.

SUMMARY OF THE INVENTION

The object of the invention is to simplify the design of the device for carrying the umbrella.

Another object is to increase convenience of use of umbrellas with long as well as with short sticks.

Still another object is to facilitate the use of the device with umbrellas having handles of various configurations.

Still another object is to minimize the weight of the device.

The problems are solved by a device for carrying an umbrella comprising a tape support which is fastened on the upper part of the torso of a user to embrace the arm of one hand and the armpit of the other hand and a pocket for receiving a handle of a stick of the umbrella. According to the invention, the device is provided with an additional tape support which is attachable to the occipitofrontal part of the head of a user and with means for holding the upper part of the umbrella stick in its unfolded position to the auxiliary tape support. The pocket has means for holding the handle of the umbrella of any shape when the umbrella is suspended along the user's body and is folded.

This construction of the device ensures simple and reliable holding of both telescopic and long-stick umbrellas through the attachment of the umbrella stick at two spaced points. This holding of the umbrella stick to the tape supports provided on the upper part of the torso and occipitofrontal part of the head does not restrain body movements, head turning or umbrella movement in the vertical plane with respect to the head. The device has a small size so that it can be stored with the umbrella in its dome or case.

The means for holding the umbrella handle in the pocket ensures versatility of the device for carrying umbrellas with any configuration of the stick handle.

In the device according to the invention, the pocket attached to the tape support is rotatable with respect to the support under weight of the umbrella lowered to be suspended down the user's body so that the umbrella can be rapidly brought from the working to the non-working position and reliably held in the suspended position without restraining movements of the user.

To simplify the design of the device and the pocket, the pocket is to be preferably made of elastic material and to be divided into longitudinally extending sections of different cross-sectional areas to fix umbrella handles of various configurations.

For a more reliable holding of the umbrella in the lowered (non-working) position when the umbrella has a cylindrically shaped handle or a handle tapering up, an auxiliary tape retainer may be provided on the top part of the pocket in the form of a loop embracing the upper end of the handle so as to make the device versatile.

To eliminate unpleasant sensations when the auxiliary support is fixed on the head and to ensure a milder contact and embracing of the occipetofrontal part of the head, the auxiliary tape support is to be preferably made of elastic material so that the umbrella might be carried in the unfolded position for a period of time.

The auxiliary tape support may be made in the form of an adjustable ring so that the device can be used for any size of a user's head.

The auxiliary tape support and the means for holding the upper part of the umbrella stick may be made in the form of rings of different sizes for embracing the occipetofrontal part of the user's head and the umbrella stick, respectively, formed by a single tape and connected to each other by a detachable joint. This construction allows the auxiliary tape support to be rapidly fixed to the head with a rapid holding of the upper part of the umbrella stick to this support and to ensure their rapid disconnection when the umbrella is folded. When the rings are connected to each other by the detachable joint, the auxiliary support can be stored on the umbrella stick in the folded position.

To facilitate umbrella carrying, means for fixing the auxiliary tape support with respect to the user's head, e.g., under gusts of wind are preferably provided on the auxiliary support.

The means for holding the auxiliary tape support may be made in the form of a pair of abutments placed on the auxiliary tape support and held on the support behind the auricle, each abutment having a curved portion on the side facing the auricle.

The means for holding the auxiliary tape support may be in the form of a tape of elastic material mounted under the user's chin and having its ends attached by detachable joints to the auxiliary tape support behind the auricle, the tape being of adjustable length so as to be used for various types of umbrellas and for different head sizes.

To facilitate use, the tape of the means for holding the auxiliary tape support is made up of two parts with connection between them.

According to one embodiment, the means for holding the upper part of the umbrella stick are in the form of a loose loop placed on the auxiliary tape support and having its ends connected thereto, one end of the loop being rigidly secured to the auxiliary tape support and the other end being connected to it through a detachable joint.

According to another embodiment, the means for holding the upper part of the umbrella stick are in the form of a bushing put on the umbrella stick and held on the auxiliary tape support by a detachable joint.

Therefore, the device according to the invention is compact and easy to use, it ensures reliable holding of an umbrella in both working and non-working positions and is easily and reliably held on a user's body. The device can be stored both in the umbrella and in a pocket of a garment.

BRIEF DESCRIPTION OF THE DRAWINGS

The invention will now be described in detail with reference to specific embodiments shown in the accompanying drawings, wherein.

DESCRIPTION OF THE PREFERRED EMBODIMENTS

Figure 1:
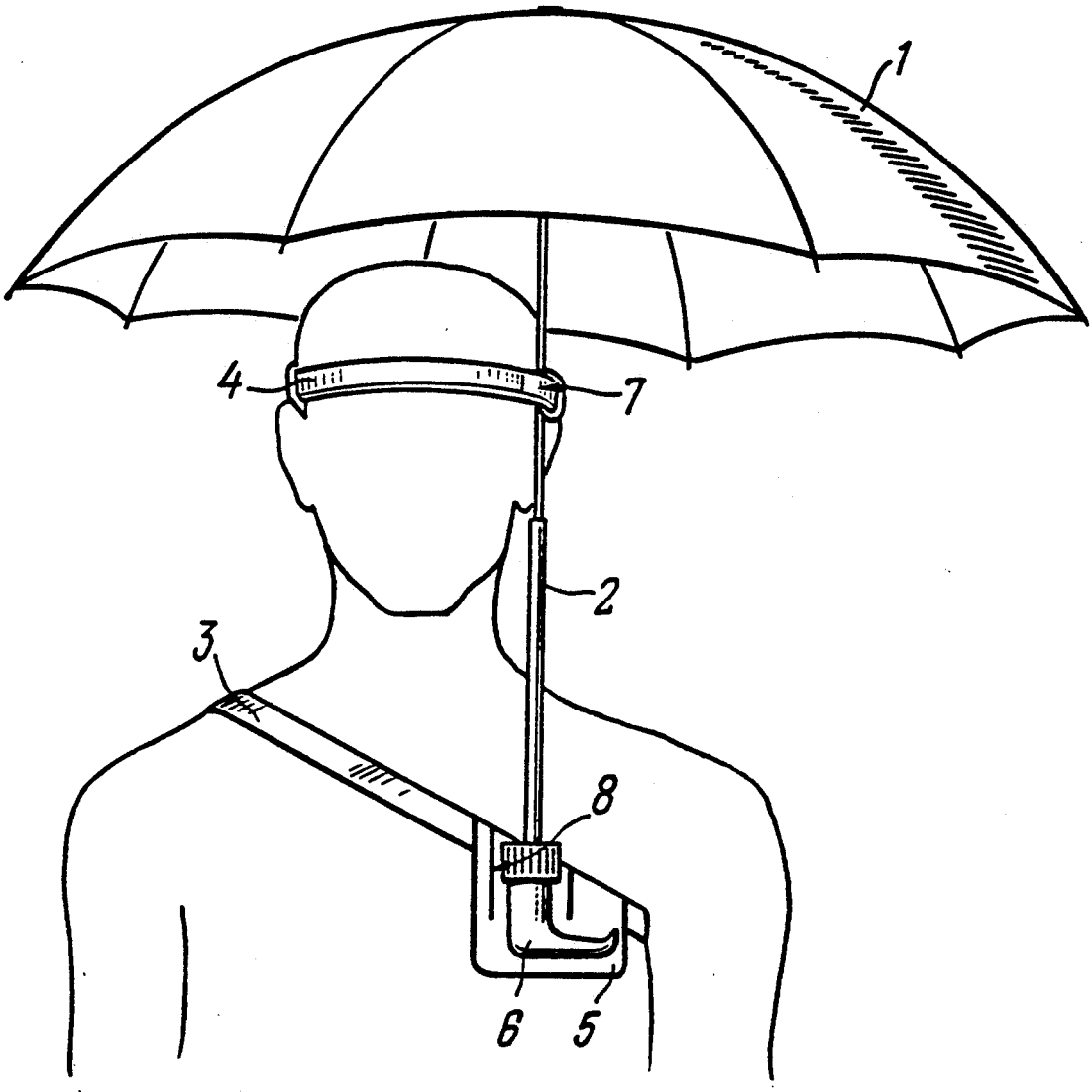
FIG. 1 is a general view of a device for carrying an umbrella according to the invention with the umbrella shown in the working position.

A device for carrying an umbrella 1 (FIG. 1), e.g., a telescopic umbrella with a short stick 2, has a tape support 3, an auxiliary tape support 4, a pocket 5 for receiving a handle 6 of umbrella 1, and means 7 for holding the upper part of stick 2 of the umbrella in the unfolded position on auxiliary tape support 4.

Auxiliary tape support 4 is attachable to the occipetofrontal part of the head of a user to embrace it as shown in FIG. 1 and is designed for holding the upper part of umbrella stick 2. Tape support 3 is attachable to the upper part of the torso of a user to embrace the shoulder of one arm and the armpit of the other arm and is designed for holding the lower part of umbrella stick 2 at handle 6.

To facilitate holding of supports 3 and 4 on a user, these supports 3 and 4 are made, e.g., in the form of rings of elastic material, e.g., of flexible rubberized textile tape which is widely used in haberdashery and knitting or of any other similar material which is determined by shape of these supports. If supports 3 and 4 are in the form of belts, they may be made of leather or unstretchable textile tape having members for connecting the ends into a ring as in ordinary belts. These belts can have portions made of an elastic material for a more intimate contact.

Figure 2:
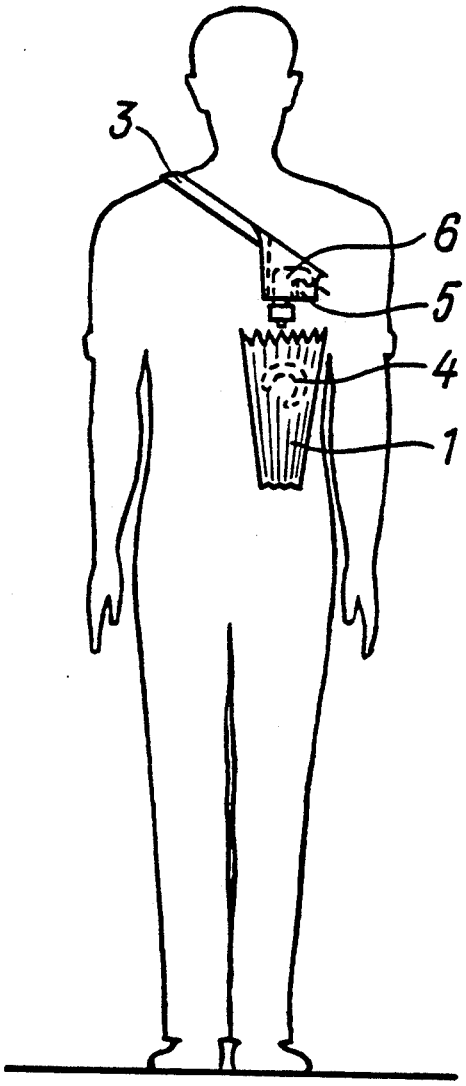
FIG. 2 is a view similar to that of FIG. 1 with the umbrella in the non-working position.

Pocket 5 is attached to tape support 3 and has means 8 for holding handle 6 of an umbrella of any configuration (cylindrical, hooked, disc-shaped or tapering up or down). To facilitate use, the pocket is made of elastic material similar to that of tape supports 3 and 4. Pocket 5 is rotatable with respect to tape support 3 under weight of the umbrella which is lowered down the torso of a user as shown in FIG. 2. For that purpose, the depth and width of pocket 5 are chosen in such a manner that only the handle of the umbrella can be received therein so as not to hamper its rotation, the pocket being rotatable under weight of the umbrella, owing to the elasticity of the tape material of support 3 which stretches under the weight of the umbrella, to be turned in the zone near attachment of the pocket and let the pocket take position shown in FIG. 2. The possibility of rotation of pocket 5 with respect to support 3 can be achieved by other means, e.g., by using simple hinges (not shown).

Figure 4:
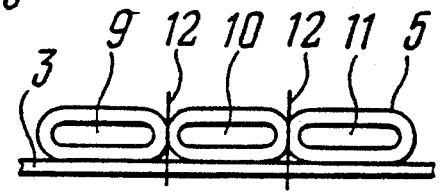
FIG. 4 is a view of the pocket of FIG. 3 from the top.
Figure 5:
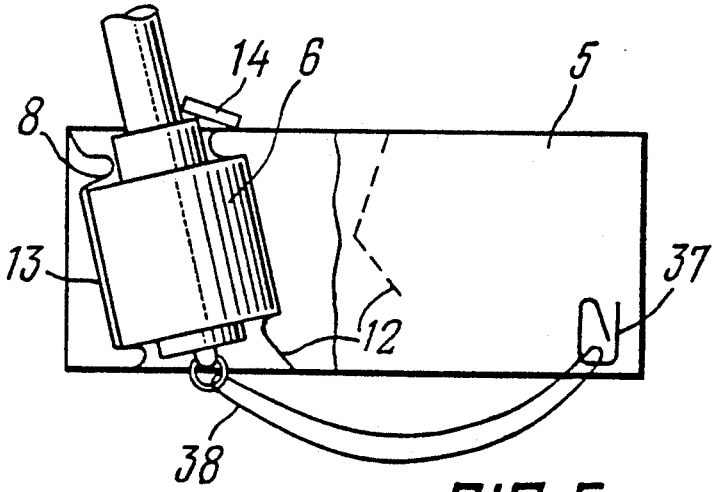
FIG. 5 shows a position of a cylindrical handle of an umbrella in one of the compartments of a pocket of FIG. 3, partially in section.

If pocket 5 is made of elastic material, means 8 for holding handle 6 of the umbrella is formed by the material of the pocket which, owing to its ability to be stretched, reliably and tightly embraces the handle of the umbrella. For more complete utilization of elasticity of the material of the pocket as the means for holding handles of various shapes, pocket 5 is transversely divided into longitudinally extending compartments 9, 10, 11 (FIGS. 3, 4) of different cross-sectional areas, e.g., by means of connecting stitches 12 which tie up the walls of the pocket. Connecting stiches 12 are made with the formation of, e.g., compartment 9 of the pocket tapering down and having an enlarged portion 13 so that cylindrical handles as shown in FIG. 5 or a handle tapering up can be received in compartment 9 with the taut material of the pocket.

Figure 3:
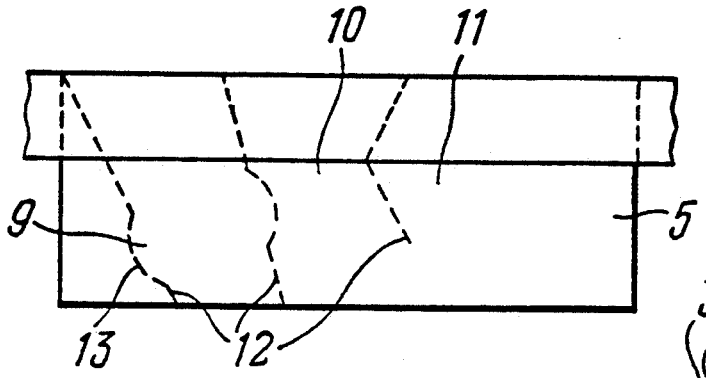
FIG. 3 shows an embodiment of a pocket, front view.
Figure 6:
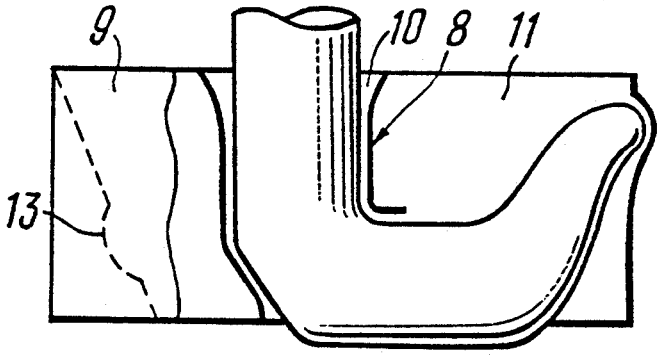
FIG. 6 shows position of a hooked handle of an umbrella in compartments of a pocket of FIG. 3, partially in section.

Connecting stitch 12 is made in the form of a broken line to define compartments 10 and 11 as shown in FIG. 3, the stitch being made in a part of depth of the pocket only so that hooked handle 6 of an umbrella can be received in pocket 5. The cylindrical portion of such a handle 6 is received in compartment 10 (FIG. 6), and the hook portion of handle 6 is received in compartment 11 through the non-stitched portion of the pocket so as to prevent the handle from falling out of the pocket upon its rotation.

Figure 7:
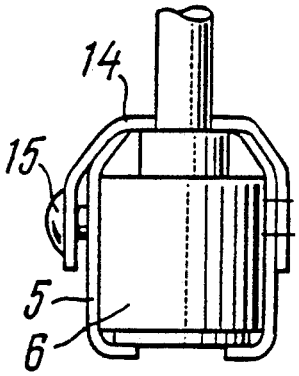
FIG. 7 is a view of the position of FIG. 5 from the side.

For a more reliable holding of handle 6 (especially if the handle tapers down), a tape type auxiliary retainer 14 (FIGS. 5, 7) is provided in the upper part of pocket 5. This retainer has one end rigidly secured to the pocket and the other end connected through detachable joint 15, e.g., a press-button one, to pocket 5 so as to loop the upper end of the umbrella handle as shown in FIG. 7.

To facilitate use of the device according to the invention, each tape support 3, 4 shaped as a ring is adjustable in length. For that purpose, the ring of auxiliary tape support 4 (FIG. 8) is made of elastic tape having one end which is permanently connected to the tape of form loop 16 and the other end which is connected by an appropriate known buckle 17 or several press-buttons (not shown) to the tape so that resulting loop 18 can change its length when buckle 17 is moved along the tape (or when different press-buttons are clamped), the loops 16 and 18 being interconnected by means of rectangular ring 19.

Figure 9:
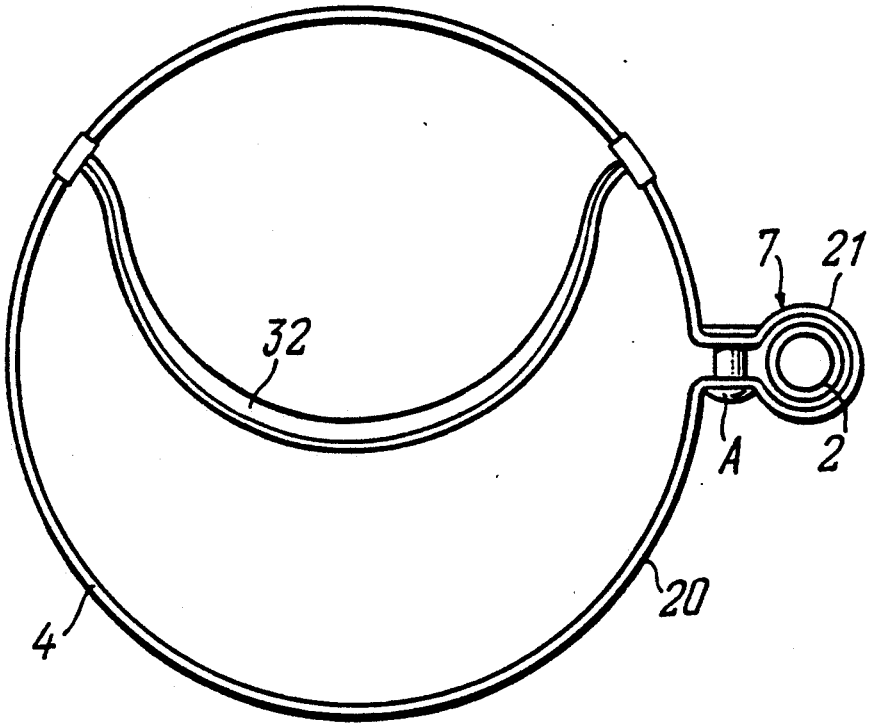
FIG. 9 is a view of another embodiment of the auxiliary tape support.

In one embodiment of the device shown in FIG. 9, auxiliary tape support 4 and means 7 for holding the upper part of stick 2 of an umbrella are in the form of differently sized rings 20 and 21. Ring 20 is designed for placement on the occipetofrontal part of the head of a user, and ring 21 embraces stick 2 of an umbrella.

Figure 10:
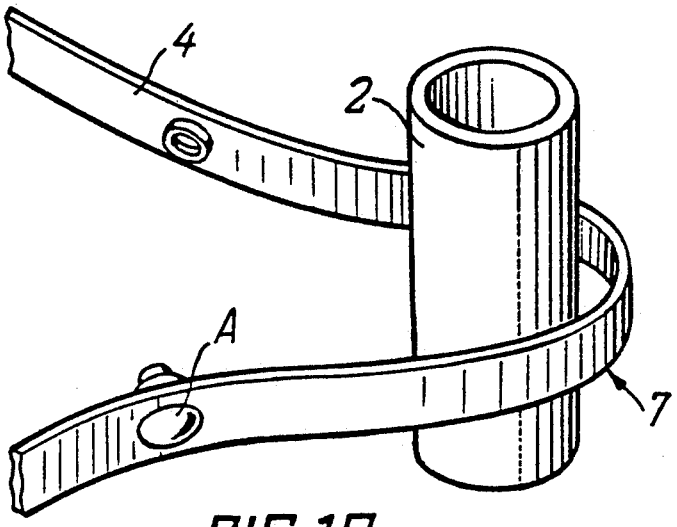
FIG. 10 is a view of an embodiment of means for fixing the upper part of a stock to the auxiliary tape support.

Rings 20 and 21 are formed by a single tape as shown in FIGS. 9 and 10 and are interconnected press-button fastener A of an appropriate known type.

Figure 8:
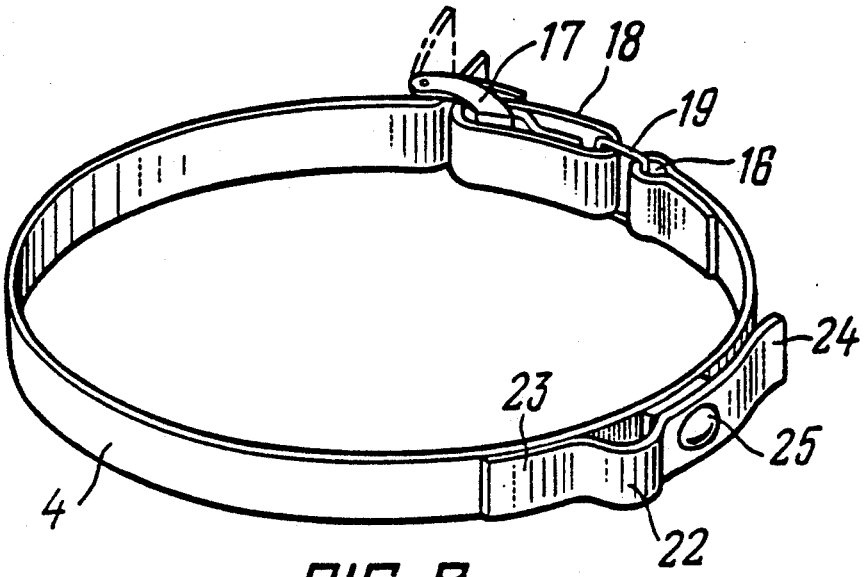
FIG. 8 is a perspective view of an auxiliary tape support of the device shown in FIG. 1.
Figure 11:
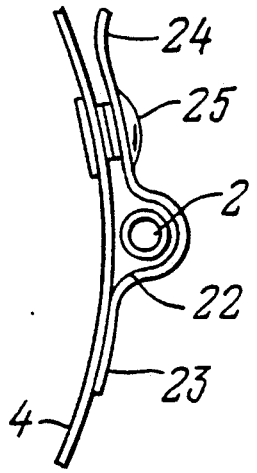
FIG. 11 is a view of an embodiment of means for fixing the upper part of a stick to the auxiliary tape support of FIG. 8.
Figure 12:
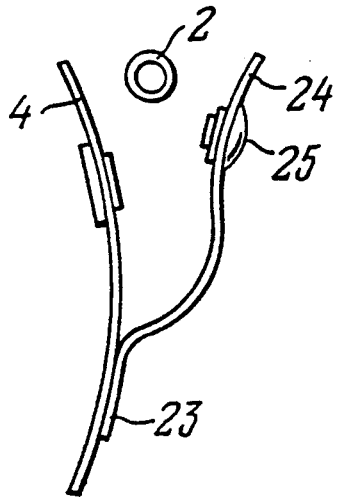
FIG. 12 is a view showing the embodiment of FIG. 11 in the unfolded position.

Means 7 for holding the upper part of stick 2 of an umbrella, as shown in FIGS. 8, 11 and 12, is in the form of a loose loop 22 placed on auxiliary tape support 4 and having its ends connected thereto. One end 23 of loop 22 is rigidly attached (e.g., stitched, cemented or welded) to auxiliary tape support 4 and the other end 24 is connected to tape support 4 by a detachable joint, e.g., by a press-button, a buckle, or a VELCRO (hook-and-pile) type fastener (not shown).

Figure 13:
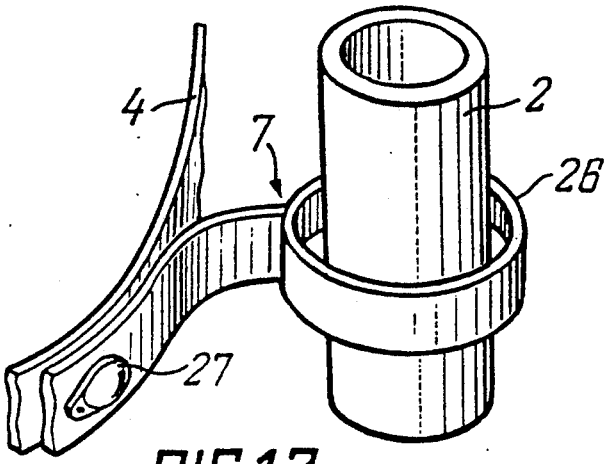
FIG. 13 is a view of still another embodiment of means for fixing the upper part of a stick to the auxiliary tape support.

Means 7 for holding the upper part of stick 2 of an umbrella to auxiliary tape support 4 as shown in FIG. 13 is in the form of a bushing 26 of elastic material which is put on stick 2 and attached to auxiliary tape support 4 by any appropriate detachable joint 27, e.g., snatch-type press-button or VELCRO (hook-and-pile) type fastener.

Figure 14:
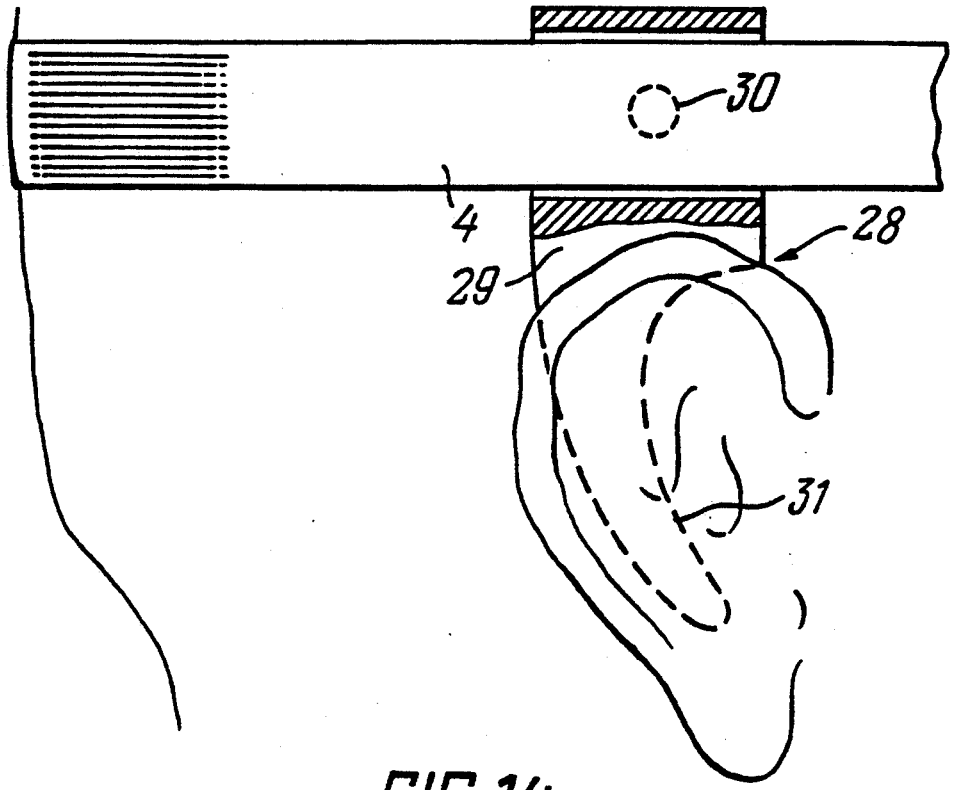
FIG. 14 is a view of an embodiment of means for fixing the auxiliary tape support.
Figure 15:
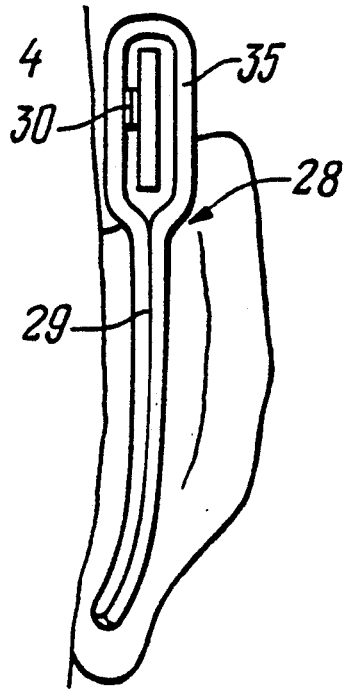
FIG. 15 is a view showing the embodiment of FIG. 14 from the rear.

To prevent rotation of auxiliary tape support 4 with respect to the head, support 4 is provided with means 28 (FIGS. 14, 15) for holding it on the head which is made as a pair of abutments 29 placed on support 4 and is held thereon by, e.g., press-buttons 30. Abutments 29 are held on auxiliary tape support 4 in such a manner that they should be behind the auricle of the user's head as schematically shown in FIG. 14 when the device is used. Abutments 29 have curved portions 31 on the side facing the auricle.

Figure 16:
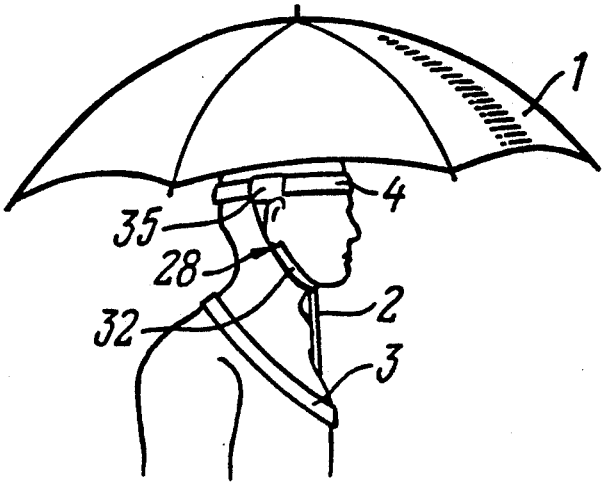
FIG. 16 is a view of another embodiment of the means for holding the auxiliary tape support.
Figure 17:
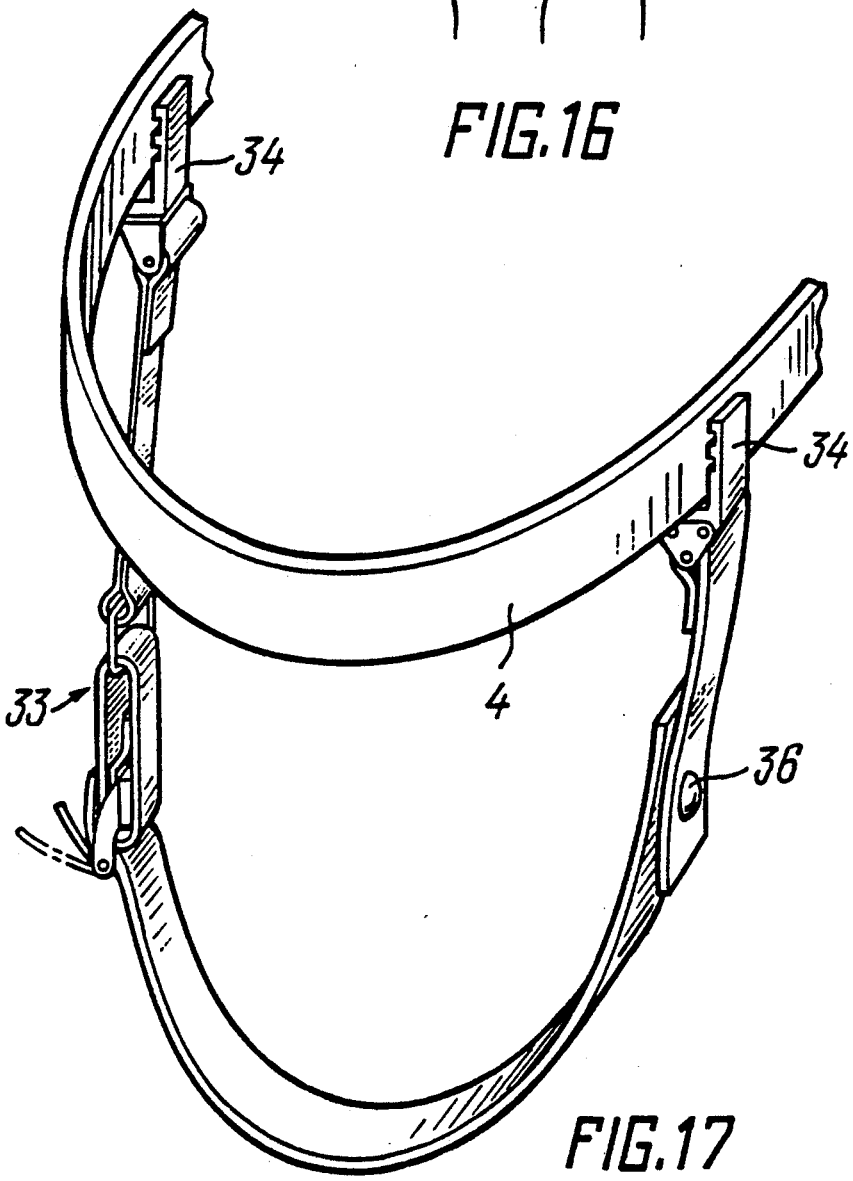
FIG. 17 is a perspective view of another embodiment of the means for holding the auxiliary tape support.

In the embodiment shown in FIG. 16, means 28 for holding auxiliary tape support 4 is in the form of elastic tape 32, e.g., ribbon or leather having an adjustable length portion 33 (FIG. 17) which is similar to an adjustable portion of tape support 4 (as shown in FIG. 8). Tape 32 is to be placed under the chin of the user's head as shown in FIG. 16.

The ends of tape 32 are connected to auxiliary tape support 4 by clamps 34 (FIG. 17) or loops 35 (FIG. 16) behind the auricle. Loops 35 are attached to support 4 by any appropriate known means. In another embodiment (FIG. 17), tape 32 is made up of two parts having means 36 for connecting them together, e.g., in the form of a press-button fastener.

A hook 37 is fixed to pocket 5 (FIG. 5) for attaching cord 38 of handle 6.

The device for carrying an umbrella according to the invention is used in the following manner.

Before unfolding an umbrella, the user puts tape support 3 on the upper part of the torso (FIG. 1) in such a manner that the support should embrace the shoulder of one arm and the armpit of the other arm as shown in FIG. 1, the pocket 5 being disposed on the front part of the torso.

Handle 6 of an umbrella is then inserted into one of the compartments of pocket 5 of tape support 3 depending on configuration of the handle and is also embraced by the loop of retainer 14 (FIG. 7) to engage the upper end of the handle if necessary.

The tape of auxiliary support 4 is then put on stick 2 of the umbrella as shown in FIGS. 9, 10.

The umbrella is then unfolded, and members of press-button fastener A are connected to each other. This fastener divides tape support 4 into two differently sized rings 20 and 21 of which one ring 21 embraces stick 2. The larger ring 21 is put on the head of the user so as to intimately embrace the occipetofrontal part of the head thereby ensuring reliable holding of support 4.

When auxiliary tape support 4 is made as shown in FIG. 8, end 24 of loose loop 22 is unfastened from auxiliary tape support 4 and is refastened to auxiliary tape support 4 after moving it around stick 2 of the umbrella. This auxiliary support 4 is placed on the head of the user before or after insertion of handle 6 of the umbrella into pocket 5.

Umbrella 1 (FIG. 1), which is thus held in the working unfolded position, is reliably held at two points placed along the stick, namely, at its handle in pocket 5 of support 3 on the breast of a user and on auxiliary support 4 held on the user's head, so the hands of the user remain free.

In case of strong wind, auxiliary support 4 is held by abutments 29 (FIGS. 14, 15) or tape 32 (FIG. 17) which are attached to support 4 in such a manner as to place them behind the auricles, the tape 32 passing under the chin as shown in FIG. 16.

By moving the tape supports along the upper part of the torso and along the occipetofrontal part of the head, respectively, the umbrella can be set to a position most suited for vision. Means 7 for holding the upper part of the umbrella stick to tape support 4 allows the stick to move vertically and prevents lateral displacements with respect to auxiliary tape support 4.

For entering a vehicle or premises, means 7 is detached (or unfastened), and the upper part of the stick is disengaged from auxiliary tape support 4. The umbrella is folded and lowered down. Pocket 5 rotates with respect to tape 3 under weight of the umbrella as shown in FIG. 2. The umbrella is held at handle 6 which is retained in the pocket of tape support 3. Auxiliary support 4 is put off the head of the user and is placed inside the umbrella.

The device for carrying an umbrella according to the invention is made of elastic (rubberized) textile tapes which are widely used in haberdashery.

What is claimed is:

1. A device for carrying an umbrella comprising:

a primary tape support attachable to an upper part of a torso of a user to embrace a shoulder of one arm and an armpit of another arm of the user;

a pocket for receiving a handle of an umbrella stick attached to said primary tape support;

means, provided on said pocket, for holding the handle of the umbrella stick when the umbrella is suspended along the torso of the user in a folded position;

an auxiliary tape support for the umbrella which is attachable to the occipitofrontal part of the head of the user; and means for fixing an upper part of the umbrella stick to said auxiliary tape support when the umbrella is in an unfolded position.

2. A device according to claim 1, wherein said pocket is attached to the primary tape support and is rotatable with respect to the primary tape support under weight of the umbrella when the umbrella is lowered along the user's body.

3. A device according to claim 2, wherein said pocket is made of elastic material and is divided into longitudinally extending compartments of different cross-sectional areas defining the means for holding the handle of the umbrella stick so that handles of various configurations can be held.

4. A device according to claim 2, and further comprising an auxiliary tape-type retainer which is placed on top of the pocket and which has the form of a loop embracing an upper end of the handle of the umbrella stick.

5. A device according to claim 1, wherein the auxiliary tape support is made of elastic material.

6. A device according to claim 5, wherein said auxiliary tape support is an adjustable ring.

7. A device according to claim 5, wherein said auxiliary tape support and the means for fixing the upper part of the umbrella stick are made in the form of differently sized rings for embracing the occipetofrontal part of the head of the user and the umbrella stick, respectively, formed by a single tape and connected to each other by a detachable joint.

8. A device according to claim 1, wherein the means for fixing the upper part of the umbrella stick to the auxiliary tape support is provided on the auxiliary tape support.

9. A device according to claim 8, wherein the means for fixing the upper part of the umbrella stick to the auxiliary tape support includes a pair of abutments provided on the auxiliary tape support and held thereon behind auricles of the user, each abutment having a curved portion on a side thereof facing an auricle of the user.

10. A device according to claim 8, wherein the means for fixing the upper part of the umbrella stick to the auxiliary tape support is a tape of elastic flexible material and adjustable length mounted under the chin of the user and having its end attached by detachable joints to the auxiliary tape support behind auricles of the user.

11. A device according to claim 10, wherein the tape is made up of two parts, the device further comprising means for connecting said parts to each other.

12. A device according to claim 1, wherein the means for fixing the upper part of the umbrella stick are in the form of a loose loop placed on the auxiliary tape support with its ends connected thereto, one end of the loop being rigidly secured to the auxiliary tape support (4) and the other end being connected to it through a detachable joint.

13. A device according to claim 1, wherein the means for fixing the upper part of the umbrella stick are in the form of a bushing put on the umbrella stick and held on the auxiliary tape-support by a detachable joint.

* * * * *